US006602006B2

(12) United States Patent
Saksa

(10) Patent No.: US 6,602,006 B2
(45) Date of Patent: Aug. 5, 2003

(54) TECHNIQUES FOR PRINTING ONTO A TRANSPARENT RECEPTOR MEDIA USING AN INKJET PRINTER

(75) Inventor: Thomas A. Saksa, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/895,346

(22) Filed: Jun. 29, 2001

(65) Prior Publication Data

US 2003/0002906 A1 Jan. 2, 2003

(51) Int. Cl.[7] ..... B41J 11/26; B41J 2/01
(52) U.S. Cl. ..... 400/611; 347/103
(58) Field of Search ..... 400/611; 101/170, 101/484; 281/2; 156/240, 230, 247; 347/105, 103; 428/195

(56) References Cited

U.S. PATENT DOCUMENTS

| | | | | | |
|---|---|---|---|---|---|
| 3,874,893 | A | * | 4/1975 | Cherrin | 428/189 |
| 3,896,249 | A | | 7/1975 | Keeling et al. | 428/202 |
| 4,037,008 | A | | 7/1977 | Tugwell | 428/200 |
| 4,308,310 | A | | 12/1981 | Arnold et al. | 428/195 |
| 4,517,044 | A | * | 5/1985 | Arnold | 156/277 |
| 4,927,278 | A | | 5/1990 | Kuzuya et al. | 400/208 |
| 5,040,317 | A | | 8/1991 | Kadjevich | 40/324 |
| 5,073,423 | A | | 12/1991 | Johnson et al. | 428/40 |
| 5,681,644 | A | | 10/1997 | Dressler | 428/195 |
| 5,681,645 | A | * | 10/1997 | Strack et al. | 428/196 |
| 5,978,004 | A | | 11/1999 | Ehrhardt | 347/171 |
| 6,071,368 | A | * | 6/2000 | Boyd et al. | 156/240 |
| 6,086,702 | A | | 7/2000 | Rea | 156/247 |
| 6,114,022 | A | | 9/2000 | Warner et al. | 428/315.5 |
| 6,143,407 | A | | 11/2000 | Lythgoe et al. | 428/354 |
| 6,151,037 | A | | 11/2000 | Kaufman et al. | 347/2 |
| 6,190,065 | B1 | | 2/2001 | Brzuskiewicz | 400/120.01 |
| 6,200,647 | B1 | | 3/2001 | Emslander et al. | 427/511 |
| 6,403,191 | B1 | * | 6/2002 | Casagrande | 428/195 |
| 6,415,842 | B1 | * | 7/2002 | Vasilakes et al. | 101/484 |

* cited by examiner

*Primary Examiner*—Raquel Yvette Gordon
*Assistant Examiner*—Manish Shah

(57) ABSTRACT

The present invention relates to a method for printing an image onto a hydrophobic, adhesive surface of a transparent, plastic receptor media using an inkjet printer. After the image is printed, the receptor media is applied to an item, thereby personalizing the item with the image. Since the image is printed onto the adhesive surface, it is protected from moisture and scuffing after it is applied to the item. The image appears professionally printed on the item because the transparent receptor media blends with the background of the item and appears borderless. However, since the image is printed using an inkjet printer, the personalized item can be easily created at home.

23 Claims, 3 Drawing Sheets

TECHNIQUES FOR PRINTING ONTO A TRANSPARENT RECEPTOR MEDIA USING AN INKJET PRINTER

FIELD OF THE INVENTION

The present invention generally relates to a method of printing onto a transparent receptor media, and in particular, to a method of printing an image onto an adhesive layer of a receptor media using an inkjet printer.

BACKGROUND OF THE INVENTION

Printed labels are used as a convenient way to provide information or personalize items. For instance, labels on consumer items contain bar codes for inventory control, price information, or to generally identify characteristics of the goods or the source of such goods. Labels on food items contain images, such as text or graphics, that describe or portray the product.

The image on a label is typically printed onto the upper surface of the label. Since the image is exposed, it is vulnerable to moisture and scuffing, which cause the quality of the image to deteriorate. In commercial applications, the image is commonly protected by applying a clear film over the image. When the printed label is applied to the item, a border is created because the label is thick and does not blend into the background of the item. This commonly happens when a white label is applied to a colored background. While aesthetic concerns are not an issue in all applications, aesthetics are important when the user wants the labeled item to look professional. For these applications, images are printed onto transparent labels so that the label blends into the background of the item. However, the print is located on the upper surface of the label and is, therefore, still exposed to moisture and scuffing. For home uses, the image may be laminated to protect it from moisture and scuffing. However, this approach is disadvantageous since lamination increases the overall thickness of the image, adds additional steps to the process, and requires a laminating device.

Other known approaches involve using inkjet receptor compositions suitable for coating onto plastics to make the plastics inkjet receptive. For example, applications for overhead transparencies are known in the art. These are composed of transparent plastic materials such as polyester, which alone will not accept the aqueous inks and are therefore coated with receptor layers. Typically these receptor layers are composed of mixtures of water soluble polymers which can absorb the aqueous mixture from which the inkjet ink comprises, such as hydrophilic layers having poly(vinyl pyrrolidone) or poly(vinyl alcohol), as described in U.S. Pat. Nos. 4,379,804; 4,903,041; and 4,904,519. Also known are methods of cross-linking hydrophilic polymers in the receptor layers as disclosed in U.S. Pat. Nos. 4,649,064; 5,141,797; 5,023,129; 5,208,092; and 5,212,008. Other coating compositions contain water-absorbing particulates such as inorganic oxides, as disclosed in U.S. Pat. Nos. 5,084,338; 5,023,129; and 5,002,825, or those containing particulates, such as corn starch, as disclosed in U.S. Pat. No. 4,935,307 and 5,302,437.

Many of these types of inkjet receptor media, however, are less than ideal for image graphics because they include water-sensitive polymer layers. Even if subsequently overlaminated, they still contain a water-soluble or water-swellable layer, which, in time, can be subject to extraction with water and can lead to damage of the graphic and liftoff of the overlaminate. Additionally, some of the common constituents of these hydrophilic coatings contain water-soluble polymers not ideally suitable to the heat and UV exposures experienced in exterior environments, thus limiting their exterior durability. Finally, the drying rate after printing of these materials appears slow since until dry, the coating is plasticized or even partially dissolved by the ink solvents (mainly water) so that the image can be easily damaged and can be tacky before it is dry.

In the commercial setting, labels are printed by a number of processes known in the art, such as screen printing, thermal transfer printing, and inkjet printing. These processes vary dramatically in cost and the resolution of the printed images that are produced. Screen printing and thermal transfer printing are typically limited to commercial applications because they produce large numbers of identical labels and require use of expensive equipment. Screen printing is commonly used to print the transparent labels, such as those used on electronics and appliances. While the images may be screen-printed onto the reverse side of a transparent label, the adhesive is applied after the image is printed, which adds an additional step to the process, making it impractical or cost prohibitive for low-volume, non-commercial, or personal use.

Thermal transfer printing is a contact printing process where a thermally reactive ribbon is located between a thermal printhead and a print media onto which the image is to be printed. The printhead contains heating elements that are selectively energized. As the ribbon is heated, ink is transferred from the ribbon to the print media to create the printed image. Images created by thermal transfer printing are located on the upper surface of the media and are, therefore, vulnerable to moisture and scuffing. To print multi-color images, multiple printheads must be linked together, which significantly adds to the cost of the printer. The high cost of thermal transfer printers makes it economically impractical for them to be used as personal printers.

An exemplary type of thermal transfer printer is a label printer. Label printers are commonly used in grocery stores to label food items with transparent labels. An exemplary label printer is disclosed in U.S. Pat. No. 4,927,278 issued to Kuzuya et al. Label printers currently available on the market include products by Kroy LLC and Zebra Technologies.

Inkjet printers have come into general use for wide-format electronic printing for a wide and varied range of applications. Because of the simplicity of operation and economy of inkjet printers, this image process holds a superior growth potential promise for the printing industry to produce wide format, image on demand, presentation quality graphics. The components of an inkjet system used for making graphics can be grouped into three major categories: 1) computer, software, printer; 2) ink; and 3) receptor medium. The computer, software, and printer will control the size, number and placement of the ink drops and will transport the receptor medium through the printer. The ink will contain the colorant which forms the image and carrier for that colorant. The receptor medium provides the repository which accepts and holds the ink. The quality of the inkjet image is a function of the total system. However, the composition and interaction between the ink and receptor medium is most important in an inkjet system.

Inkjet printers are commonly purchased as personal printers because they are easy to use, produce high quality, color images, and are less expensive than thermal transfer printers. Inkjet printers are also available in a variety of formats that allow the user to print professional-looking banners or labels at home. Ink-jet printing is a non-contact printing process in which droplets of ink are deposited on a print media. In response to electrical signals generated by a microprocessor, fine droplets of ink are ejected onto print media such as paper, transparency film, or textiles. The ejection of ink droplets in a particular order forms alphanumeric characters, area fills, and other patterns on the print media. Images are printed onto many types of media including paper or transparent, plastic receptor media such as transparent labels or overhead transparencies. However, inkjet inks compositions are substantially aqueous-based and do not adhere to the inherently hydrophobic surface of the plastic receptor media. Therefore, to print images onto plastic receptor media, these media must first be coated with a hydrophilic film to improve the adhesion of the inkjet ink onto the media. However, since the image is printed on top of the film, the image is not protected from moisture and scuffing.

To solve the problems described above, it would be advantageous to use the inkjet printer to print an image on a hydrophobic or adhesive layer of a transparent receptor media. This would provide an affordable way of printing borderless labels that would be resistant to moisture and scuffing.

SUMMARY OF THE INVENTION

The present invention relates to a method for printing an image onto an adhesive surface of a transparent, plastic receptor media using an inkjet printer. After the image is printed, the receptor media is applied to an item, thereby personalizing the item with the image. Since the image is printed onto the adhesive surface, it is protected from moisture and scuffing after it is applied to the item. The image appears professionally printed on the item because the transparent receptor media blends with the background of the item and appears borderless. However, since the image is printed using an inkjet printer, the personalized item can be created at home or in low-quantity application settings.

DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

The present invention relates to a method for printing an image onto a hydrophobic, adhesive surface of a transparent, plastic receptor media. Generally, the image is printed onto the surface using an inkjet printer. After the image is printed, the receptor media is applied to an item, thereby personalizing the item with the image. Since the image is printed onto the hydrophobic surface, it is protected from moisture and scuffing after it is applied to the item.

Figure 1:
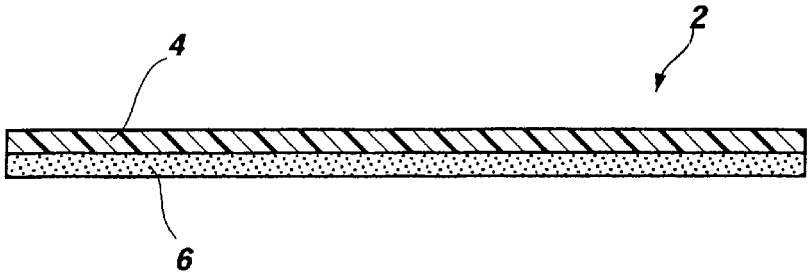
FIG. 1 shows a transparent tape of one embodiment of the present invention.

The receptor media 2 of the present invention is transparent and has a plastic layer 4 on the top surface and an adhesive layer 6 on the bottom surface, as shown in FIG. 1. The plastic layer 4 is composed of any thin, flexible plastic known in the art, such as polyester, vinyl, Mylar® (polyethylene terephthalate), or cellophane. The adhesive layer 6 is composed of any suitable adhesive known in the art, such as gummed adhesive, acrylic adhesive, or a pressure sensitive adhesive. The receptor media 2 is preferably a transparent tape and may include, but is not limited to, cellophane tape or a more permanent, adhesive tape. The receptor media 2 may also include transparent printer labels, which are known in the art.

Figure 2:
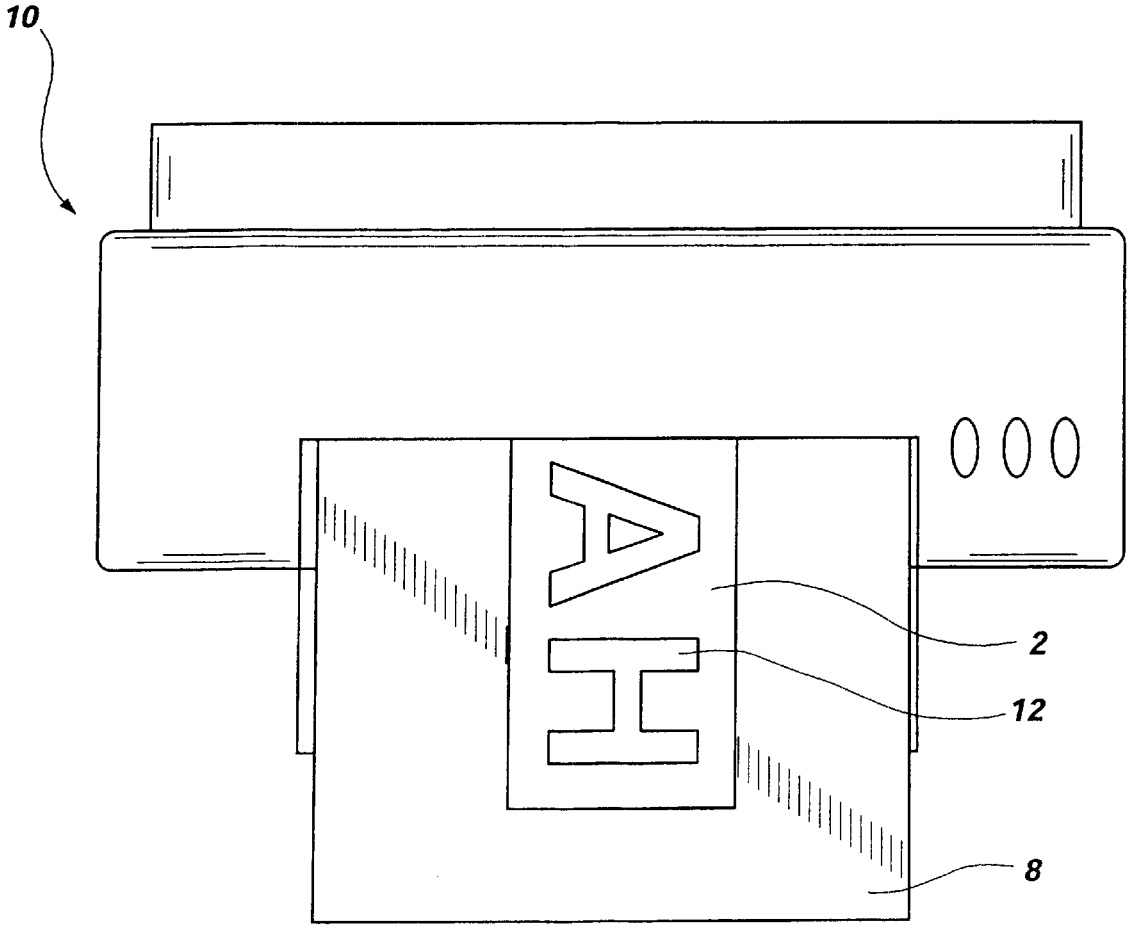
FIG. 2 depicts the transparent tape of one embodiment of the present invention being fed through the inkjet printer with the resulting image printed in reverse.

The receptor media 2 is attached to a carrier 8 that is fed through an inkjet printer 10, as illustrated in FIG. 2. For example, the receptor media 2 may be attached to an 8½×11 inch sheet of printer labels. To attach the receptor media 2 to the sheet, the backing of the sheet is partially peeled back and a window is cut in the backing so that the adhesive of the printer labels is exposed or uncovered. The window must be an appropriate size to firmly attach the receptor media 2. The receptor media 2 is placed into the window so that its adhesive layer 6 is facing outwardly to receive ink during the printing process. The receptor media 2 is firmly held in place by the adhesive of the printer labels. In a variation of this embodiment, the receptor media 2 may be attached to the sheet of printer labels by cutting a window in the label. The window must be slightly smaller than the size of the receptor media 2 so that the receptor media is firmly held in place.

Alternatively, if the receptor media 2 is a sheet of transparent printer labels, a window may be cut into the backing sheet, thus exposing the adhesive side of the labels to be printed on. Depending on the size of the printer labels and the desired images, one or more windows may be cut into the backing. It is understood that any other means of feeding the receptor media through the inkjet printer are included within the scope of the invention.

It is also understood that the inkjet printer 10 may be modified so that the receptor media 2 is directly passed through the printer. For example, a carriage of the inkjet printer 10 may be increased in width to allow the receptor media 2 to be accommodated while still allowing for normal printing applications.

Referring to FIG. 2, an image 12 is printed directly onto the adhesive layer of the receptor media 2 using the inkjet printer 10. In a preferred embodiment of the present invention, the receptor media 2 is transparent tape. However, it is understood that this printing process can be used with any suitable, transparent receptor media known in the art. To begin the process, the receptor media (e.g., a piece of transparent tape) of an appropriate size to fit a reselected image is provided. The image 12 can be a combination of text or graphics and is limited only by the resolution of the inkjet printer. The image 12 is printed onto the receptor media 2 by feeding the carrier 8, to which the receptor media 2 is attached, through the inkjet printer 10. As with standard inkjet operation, the printing process is controlled so that ink does not pool on the adhesive layer 6 of the receptor media 2. The resulting image appears as a reverse image on the adhesive layer 6 of the receptor media 2. Since inkjet printing is a non-contact printing process, the internal components of the inkjet printer 10 will not contact the receptor media 2. By way of contrast, if the receptor media 2 was used in a contact printing processes, such as thermal transfer printing, the ribbon would adhere to the adhesive layer 6 of the receptor media 2 and prevent the receptor media from traveling through the printer. An image is thus created on the adhesive layer of the receptor media 2 such that it forms a positive image when viewed from the top surface (plastic layer 4) of the receptor media 2.

Once the ink has dried or set, the image 12 may be applied to any item or object by adhering the tape to the item. Since the ink is printed on the adhesive layer 6 of the receptor media 2, the drying time may under some circumstances be longer than if the image had been printed on plain printer paper. Therefore, to decrease the drying time, use of fast drying inks are preferred. Once applied to an object, the printed image 12 is sandwiched between the plastic layer 4 and the object to which the receptor media 2 has been applied.

The present method of printing labels possesses a number of advantages. For example, since the image is printed on the adhesive layer 6 of the receptor media 2, the image 12 is protected from moisture and scuffing when the receptor media 2 is applied to the item. Additionally, the resulting personalized item looks professionally created because the label appears to be borderless.

The printing process of the present invention can be easily performed at home using an unmodified inkjet printer. Since inkjet printers 10 are easy to use, readily available, and relatively inexpensive, this process is useful for low-volume applications or applications where the image on each label is different. Alternatively, the present printing process can be performed using an inkjet printer that has been modified to handle the receptor media 2 of the invention. For example, a printer could be modified by repositioning the drive or feed rollers of an inkjet printer such that the drive rollers have limited contact with the adhesive layer 6 of the receptor media 2, such as positioning the same between labels or at an outer periphery of the receptor media 2 that is free of adhesive. Alternatively, the drive rollers can be redesigned to assume a shape that limits or prevents contact of the same with the adhesive layer 6, such as providing sprocket wheels in place of the rubber wheels typically found in printers. In yet another embodiment of the printing process, the printer may be modified to include a paper path that permits the receptor media 2 to pass through the printer and printing elements therein with minimal or no contact to the adhesive layer 6 thereof.

In an alternate embodiment of the present invention, the image 12 may be printed onto the receptor media 2 by a transfer printing technique. The image 12 is first printed onto a smooth, slick media, such as a transparent, plastic sheet or coated paper. Since the ink does not readily absorb into this media, the image 12 can be easily transferred to a second plastic sheet by applying a clear, self-adhesive plastic sheet over the image 12. When the second sheet is removed, the ink is transferred to the adhesive layer of the second sheet. The second sheet may then be placed on the item to be personalized.

Figure 3:
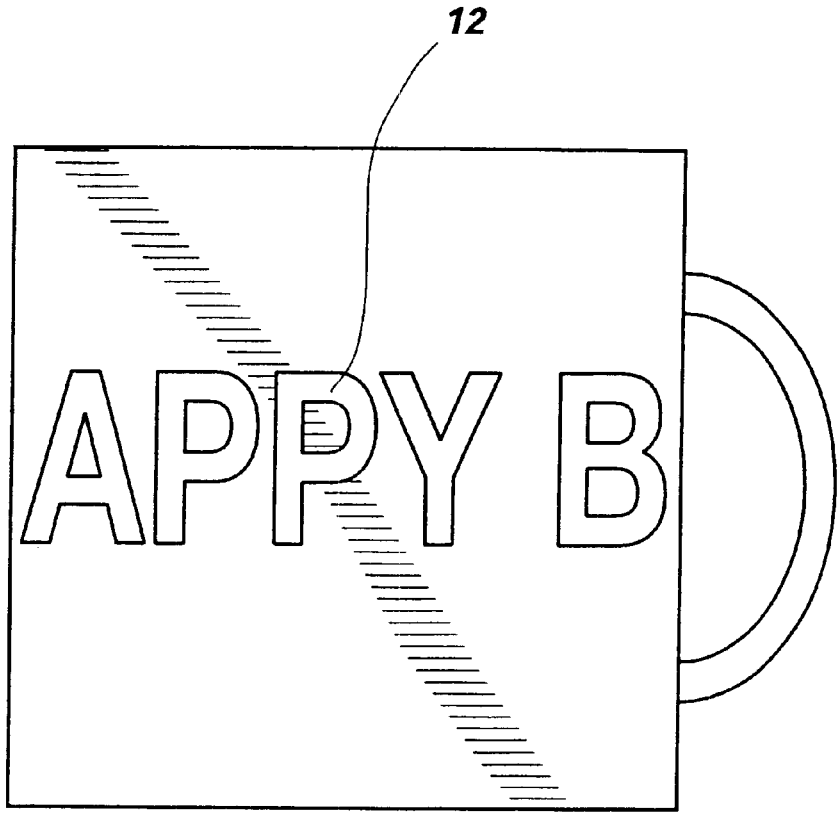
FIG. 3 shows a printed image adhered to a coffee mug.
Figure 4:
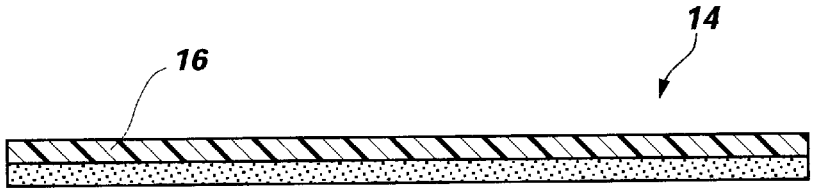
FIG. 4 shows the transfer media of one embodiment of the present invention.
Figure 5:
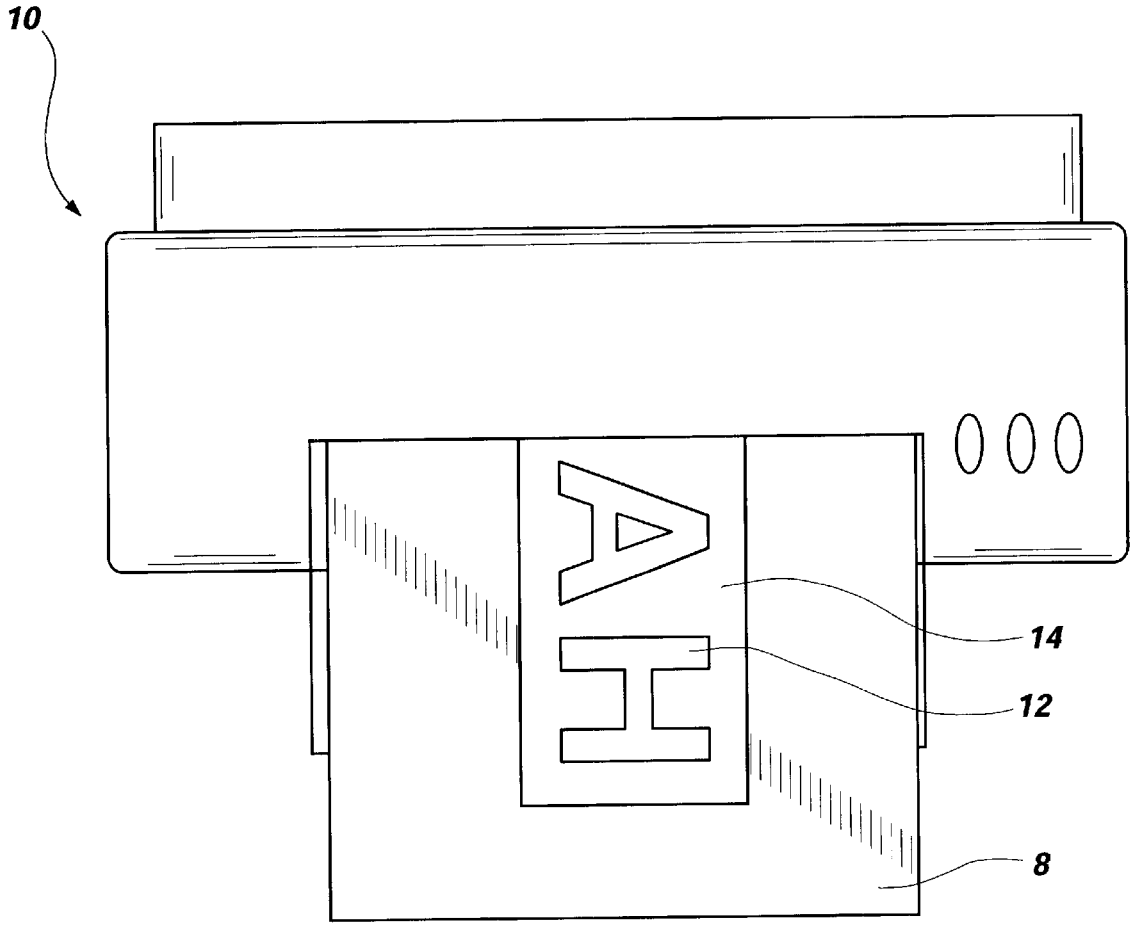
FIG. 5 depicts the transfer media of one embodiment of the present invention being fed through the inkjet printer with the resulting image printed thereon.

In an alternative embodiment of the invention, an image 12 may be printed onto an object through use of transfer media 14. The transfer media 14 has at least one surface 16 that includes a slick material that resists absorbing ink, as shown in FIG. 4. An image 12 to be printed is then selected. The transfer media 14 is attached to a carrier 8, fed through an inkjet printer 10, where the image 12 is printed onto at least one surface of the transfer media 14, as shown in FIG. 5. Receptor media 2 having a plastic layer 4 on a top surface and an adhesive layer 6 on a bottom surface is provided (FIG. 1). The adhesive layer 6 of the receptor media 2 is then pressed onto the printed image 12 on the at least one surface 16 of the transfer media 14 to transfer the image 12 onto the receptor media 2 and to create a printed image that is adherable to a surface. The receptor media 2 having the printed image 12 may then be applied onto the target object, as shown in FIG. 3.

In another alternative embodiment, the adhesive layer 6 of the receptor media 2 may include a pressure-sensitive adhesive. Where the pressure sensitive adhesive is used, the receptor media 2 is easily removed and repositioned, which is desirable when, for example, a user wishes to label or highlight photographs without leaving permanent marks.

In yet another alternative embodiment, the image 12 may be printed on the plastic layer 4 and then overlaid with the adhesive layer 6. The adhesive layer 6 could be applied by a modified head in the inkjet printer 10, by an aerosol sprayer that was part of the printer, or by independently applying the adhesive layer 6 over the image 12 after the image 12 was printed onto the plastic layer 4 using the previously described techniques of the present invention.

The present invention is designed for use with standard inkjet ink cartridges, such as monochromatic (e.g. single color images) or multi-color ink cartridge units. Accordingly, the present invention shall not be exclusively limited to any particular type of thermal inkjet delivery system, with many different systems being suitable for use. For example, representative commercially-available ink cartridge units which may be employed in connection with the claimed process can be obtained from the Hewlett-Packard Company of Palo Alto, Calif. (USA) under the following product designations/numbers: 51641A, 51645A, 51640C, 51640A, 51629A, and 51649A.

Many different ink materials may be used in producing printed images on the adhesive layer of the receptor media in accordance with the present invention. In this regard, the invention shall not be restricted to the generation of images using any particular ink product. However, at a minimum, the selected ink composition will include an ink vehicle and at least one coloring agent, with the term "coloring agent" being defined to encompass a wide variety of different dye materials and colors including black.

Additional dye materials suitable for use in the invention as the coloring agent are described in the Color Index, Vol. 4, 3rd ed., published by The Society of Dyers and Colourists, Yorkshire, England (1971), which is a standard text that is well known in the art. Exemplary dye materials listed in the Color Index, supra, which are appropriate for use herein include but are not limited to the following compositions: C.I. Direct Yellow 11, C.I. Direct Yellow 86, C.I. Direct Yellow 132, C.I. Direct Yellow 142, C.I. Direct Red 9, C.I. Direct Red 24, C.I. Direct Red 227, C.I. Direct Red 239, C.I. Direct Blue 9, C.I. Direct Blue 86, C.I. Direct Blue 189, C.I. Direct Blue 199, C.I. Direct Black 19, C.I. Direct Black 22, C.I. Direct Black 51, C.I. Direct Black 163, C.I. Direct Black 169, C.I. Acid Yellow 3, C.I. Acid Yellow 17, C.I. Acid Yellow 23, C.I. Acid Yellow 73, C.I. Acid Red 18, C.I. Acid Red 33, C.I. Acid Red 52, C.I. Acid Red 289, C.I. Acid Blue 9, C.I. Acid Blue 61:1, C.I. Acid Blue 72, C.I. Acid Black 1, C.I. Acid Black 2, C.I. Acid Black 194, C.I. Reactive Yellow 58, C.I. Reactive Yellow 162, C.I. Reactive Yellow 163, C.I. Reactive Red 21, C.I. Reactive Red 159, C.I. Reactive Red 180, C.I. Reactive Blue 79, C.I. Reactive Blue 216, C.I. Reactive Blue 227, C.I. Reactive Black 5, C.I. Reactive Black 31, and mixtures thereof. These representative materials are known in the art and commercially available from a variety of sources. Representative sources for dye materials of the type described above and dye sets which may be used in the present invention include but are not limited to the Hewlett-Packard Company of Palo Alto, Calif. (ISA), Sands Corporation of East Hanover, N.J. (USA), Ciba-Geigy of Ardsley, N.Y. (USA), and others.

It should also be noted that the term "coloring agent" as used herein shall further encompass pigment dispersion materials known in the art which basically involve a water insoluble colorant (e.g. a pigment) which is rendered soluble through association with a dispersant (e.g. an acrylic dispersant). Specific pigments which may be employed to produce pigment dispersion materials are known in the art, and the present invention shall not be restricted to any particular chemical compositions in this regard. However, as previously indicated, the claimed invention shall not be limited to the dyes and/or pigment dispersion materials listed above. Other chemically comparable materials may be employed which are determined by reasonable investigation to be suitable for the purposes set forth herein. In a preferred embodiment, the ink composition of the invention will include about 2–7% by weight total coloring agent therein (e.g. whether a single coloring agent or combined coloring agents are used).

The ink composition will also include an ink "vehicle" which is essentially used as a carrier medium for the other components in the completed ink product. Many different materials may be employed as the ink vehicle, with the present invention not being limited to any particular compositions for this purpose. A preferred ink vehicle will consist of water, although other supplemental compositions in combination with water including 2-pyrrolidone, ethoxylated glycerol, diethylene glycol, 1,5-pentanediol, N-methyl pyrrolidone, 2-propanol, and 2-ethyl-2-hydroxymethyl-1,3-propanediol may be employed. All of these materials can be used in various combinations as determined by preliminary pilot studies involving the ink compositions of concern. However, in a preferred embodiment, the ink composition will include about 70–80% by weight total combined ink vehicle, wherein at least about 30% by weight or more of the total ink vehicle will involve water (with the balance consisting of any one of the above-listed supplemental compositions).

The ink composition may also include a number of optional ingredients in varying amounts. For example, an optional biocide may be added to prevent any microbial growth in the final ink product, Exemplary biocides suitable for this purpose would include proprietary products sold under the trademarks PROXEL GXL by Imperial Chemical Industries of Manchester, England; UCARCIDE 250 by Union Carbide of Danbury, Conn. (USA); and NUOSEPT 95 by Huls America, Inc. of Piscataway, N.J. (USA). Another optional ingredient to be added to the ink composition will involve one or more buffering agents. The use of a selected buffering agent or multiple (combined) buffering agents is designed to stabilize the pH of the ink composition. In a preferred embodiment, the desired pH of the ink composition will range from about 4–9. Exemplary buffering agents suitable for this purpose will comprise sodium borate, boric acid, and phosphate buffering materials known in the art for pH control. The selection of any particular buffering agents and the amount of buffering agents to be used (as well the decision to use buffering agents in general) will be determined in accordance with preliminary pilot studies on the particular ink compositions of concern.

A still further optional ingredient which may be employed in the ink composition is an auxiliary bleed control agent. This material is especially appropriate for multi-color printing systems. Exemplary bleed control agents suitable for this purpose will involve magnesium nitrate, calcium nitrate, or mixtures of both. The selection of any given bleed control agent, the exact amount of bleed control agent to be added, and the general need for a bleed control agent may be determined in accordance with preliminary investigations involving the other components chosen for use in the ink composition. Additional ingredients (e.g. surfactants) may also be included in the ink composition if needed.

Having set forth preferred embodiments of the present invention, it is anticipated that suitable modifications may be made thereto by individuals skilled in the art which nonetheless remain within the scope of the invention. For example, the invention shall not be limited to any particular ink compositions, printing technologies, adhesives, and material layers used to manufacture the transparent receptor media. In this regard, the present invention shall only be construed in accordance with the following claims.

What is claimed is:

1. A method for printing onto a transparent receptor media comprising:

providing a transparent transfer media having at least one surface comprising a slick material resistant to absorbing ink;

attaching the transfer media to a carrier;

printing an image onto the at least one surface of the transfer media using an inkjet printer;

providing the receptor media having a plastic layer on a top surface and an adhesive layer on a bottom surface;

pressing the adhesive layer of the receptor media onto the printed image on the at least one surface of the transfer media to transfer the image onto the receptor media to create a printed image that is adherable to a surface.

2. The method of claim 1, wherein the plastic layer is selected from the group consisting of polyester, vinyl, polyethylene terephthalate and cellophane.

3. The method of claim 1, wherein the adhesive layer is selected from the group consisting of gummed adhesive, acrylic adhesive, and pressure sensitive adhesive.

4. The method of claim 1, wherein the image is transferred onto a hydrophilic adhesive layer.

5. The method of claim 4, wherein the image is transferred on the adhesive layer as a reverse image.

6. The method of claim 5, wherein the printing is controlled to prevent pooling of ink on the transfer layer.

7. A method for printing onto a transparent receptor media comprising:

providing a transfer media having at least one surface comprising a slick material resistant to absorbing ink;

selecting an image to be printed;

attaching the transfer media to a carrier;

feeding the transfer media through an inkjet printer;

printing the image onto the at least one surface of the transfer media;

providing the receptor media having a plastic layer on a top surface and an adhesive layer on a bottom surface;

pressing the adhesive layer of the receptor media onto the printed image on the at least one surface of the transfer media to transfer the image onto the receptor media to create a printed image that is adherable to a surface.

8. The method of claim 7, wherein the plastic layer is selected from the group consisting of polyester, vinyl, polyethylene terephthalate and cellophane.

9. The method of claim 7, wherein the adhesive layer is selected from the group consisting of gummed adhesive, acrylic adhesive, and pressure sensitive adhesive.

10. The method of claim 7, wherein the image is printed as a reverse image.

11. The method of claim 7, further comprising adhering the printed image to the item by applying the adhesive layer to the item.

12. The method of claim 11, wherein the printed image appears borderless when adhered to the item.

13. A method for applying a printed image onto an object comprising:

providing a transfer media having at least one surface comprising a slick material resistant to absorbing ink;

selecting an image to be printed;

attaching the transfer media to a carrier;

feeding the transfer media through an inkjet printer;

printing the image onto the at least one surface of the transfer media;

providing the receptor media having a plastic layer on a top surface and an adhesive layer on a bottom surface;

pressing the adhesive layer of the receptor media onto the printed image on the at least one surface of the transfer media to transfer the image onto the receptor media to create a printed image that is adherable to a surface and applying the receptor media having the printed image onto the object.

14. The method of claim 13, further comprising adhering the printed image to the object by applying the adhesive layer to the object.

15. The method of claim 13, wherein attaching the transfer media to a carrier comprises adhering the at least one slick surface of the transfer layer onto an adhesive layer on the carrier.

16. The method of claim 13, wherein applying the receptor media having the printed image onto the object comprises adhering the bottom surface of the receptor media onto the object.

17. A method for applying a printed image onto an object comprising:

providing a transfer media having at least one surface comprising a slick material resistant to absorbing ink;

attaching the transfer media to a carrier;

printing an image onto the at least one surface of the transfer media;

providing a receptor media having a plastic layer on a top surface and an adhesive layer on a bottom surface;

transfering the image onto the receptor media to create a printed image that is adherable to a surface; and applying the receptor media having the printed image onto the object.

18. The method of claim 17, further comprising adhering the printed image to the object by applying the adhesive layer to the object.

19. The method of claim 18, wherein attaching the transfer media to a carrier comprises adhering the at least one slick surface of the transfer layer onto an adhesive layer on the carrier.

20. The method of claim 17, wherein applying the receptor media having the printed image onto the object comprises adhering the bottom surface of the receptor media onto the object.

21. The method of claim 17, further comprising selecting an image to be printed prior to printing an image onto the at least one surface of the transfer media.

22. The method of claim 17, further comprising feeding the transfer media through an inkjet printer prior to printing an image onto the at least one surface of the transfer media.

23. The method of claim 17, wherein transfering the image onto the receptor media to create a printed image that is adherable to a surface comprises pressing the adhesive layer of the receptor media onto the printed image on the at least one surface of the transfer media.

* * * * *